US011459913B2

(12) United States Patent
Joo et al.

(10) Patent No.: US 11,459,913 B2
(45) Date of Patent: Oct. 4, 2022

(54) TURBINE VANE AND GAS TURBINE INCLUDING THE SAME

(71) Applicant: DOOSAN ENERBILITY CO., LTD., Changwon-si (KR)

(72) Inventors: Hyun Woo Joo, Changwon (KR); Sung Chul Jung, Daejeon (KR)

( * ) Notice: Subject to any disclaimer, the term of this patent is extended or adjusted under 35 U.S.C. 154(b) by 0 days.

(21) Appl. No.: 16/889,447

(22) Filed: Jun. 1, 2020

(65) Prior Publication Data

US 2021/0003036 A1 Jan. 7, 2021

(51) Int. Cl.
*F01D 25/24* (2006.01)

(52) U.S. Cl.
CPC ..... *F01D 25/246* (2013.01)

(58) Field of Classification Search
CPC .. F01D 25/246; F01D 11/001; F05D 2250/38; F05D 2240/80; F05D 2260/36
USPC ..... 415/209.3
See application file for complete search history.

(56) References Cited

U.S. PATENT DOCUMENTS 6,425,738 B1 * 7/2002 Shaw ..... F01D 9/041 415/209.2
6,910,854 B2 * 6/2005 Joslin ..... F01D 11/005 415/191
2010/0098537 A1 * 4/2010 Hamana ..... F01D 9/041 415/209.3
2011/0200430 A1 8/2011 Burdguck et al.
2019/0234222 A1 * 8/2019 Amadon ..... F01D 9/041

FOREIGN PATENT DOCUMENTS

| | | | |
|---|---|---|---|
| JP | 2007120321 | A | 5/2007 |
| JP | 2008144687 | A | 6/2008 |
| JP | 2013122221 | A | 6/2013 |
| KR | 1020090087930 | A | 8/2009 |
| KR | 20100064754 | A | 6/2010 |
| KR | 20120032686 | A | 10/2012 |
| KR | 101873156 | B1 | 6/2018 |
| KR | 20190037774 | A | 4/2019 |

OTHER PUBLICATIONS

Korean Office Action issued by the Korean Intellectual Property Office (KIPO) dated Jun. 26, 2020.

* cited by examiner

*Primary Examiner* — Yi-Kai Wang
(74) *Attorney, Agent, or Firm* — Harvest IP Law, LLP

(57) ABSTRACT

A turbine vane and a gas turbine including the same are provided. The turbine vane including an airfoil; an outer shroud formed at a top of the airfoil; and an inner shroud including a stress canceling part formed at a bottom of the airfoil and configured to cancel a stress applied to the airfoil by flowing combustion gas.

14 Claims, 7 Drawing Sheets

TURBINE VANE AND GAS TURBINE INCLUDING THE SAME

CROSS-REFERENCE TO RELATED APPLICATION

This application claims priority to Korean Patent Application No. 10-2019-0078765, filed on Jul. 1, 2019, the disclosure of which is incorporated by reference herein in its entirety.

BACKGROUND

Field

Apparatuses consistent with exemplary embodiments relate to a turbine vane and a gas turbine including the same

Description of the Related Art

A turbine is a mechanical device which obtains a rotational force by an impulsive force or a reaction force by using a flow of compressive fluid such as steam or gas, and includes a steam turbine using steam, a gas turbine using high-temperature combustion gas, and the like.

The gas turbine includes a compressor, a combustor, and a turbine. The compressor includes an air inlet which introduces air, and a plurality of compressor vanes and compressor blades which are alternately arranged in a compressor casing.

The combustor supplies fuel to the air compressed by the compressor and ignites a mixture of the fuel and the compressed air with a burner to generate high-temperature and high-pressure combustion gas.

The turbine includes a plurality of turbine vanes and a plurality of turbine blades which are alternately arranged in a turbine casing. Further, a rotor is arranged to penetrate central portions of the compressor, the combustor, the turbine, and an exhaust chamber.

The rotor is rotatably supported at both ends thereof by bearings. Further, a plurality of disks are fixed to the rotor to connect each blade. A drive shaft of a generator is connected to the end of the exhaust chamber side.

A gas turbine does not have a reciprocating mechanism such as a piston which is usually provided in a four-stroke engine. That is, the gas turbine has no mutual friction part, such as a piston-cylinder, thereby consuming extremely low lubricant, significantly reducing an amplitude of vibration, unlike the reciprocating machine. Therefore, high-speed driving of the gas turbine is possible.

Briefly describing an operation of the gas turbine, the air compressed by the compressor is mixed with fuel, the fuel mixture is combusted to generate high-temperature combustion gas, and the generated combustion gas is discharged to the turbine side. The discharged combustion gas generates the rotational force while passing through the turbine vane and the turbine blade, thereby rotating the rotor.

SUMMARY

Aspects of one or more exemplary embodiments provide a turbine vane and a gas turbine including the same, which may prevent a collision between a turbine rotor disk and a turbine vane upon an initial operation, and prevent a bending stress generated in the turbine vane upon a normal operation.

Additional aspects will be set forth in part in the description which follows and, in part, will become apparent from the description, or may be learned by practice of the exemplary embodiments.

According to an aspect of an exemplary embodiment, there is provided an inner shroud of a turbine vane including: a platform part configured to support an airfoil; a root part configured to be connected to a bottom surface of the platform part; and a stress canceling part formed at a bottom of the airfoil and configured to cancel a stress applied to the airfoil by flowing combustion gas.

The stress canceling part may include a protrusion configured to protrude from a bottom of one surface of the root part and a recess configured to be recessed from a bottom of the other surface of the root part.

The protrusion and the recess may include inclined surfaces at predetermined angles.

The angles of the inclined surfaces may be 5° to 45°.

If a length of the root part is 100, lengths of the protrusion and the recess may be 5 to 30.

If a height of the root part is 100, heights of the protrusion and the recess may be 10 to 40.

According to an aspect of another exemplary embodiment, there is provided a turbine vane including: an airfoil; an outer shroud formed at a top of the airfoil; and an inner shroud including a stress canceling part formed at a bottom of the airfoil and configured to cancel a stress applied to the airfoil by flowing combustion gas.

The inner shroud may include a platform part configured to support the airfoil and a root part configured to be connected to a bottom surface of the platform part, and the stress canceling part may include a protrusion configured to protrude from a bottom of one surface of the root part and a recess configured to be recessed from a bottom of the other surface of the root part.

The protrusion and the recess may include inclined surfaces at predetermined angles.

The angles of the inclined surfaces may be 5° to 45°.

If a length of the root part is 100, lengths of the protrusion and the recess may be 5 to 30.

If a height of the root part is 100, heights of the protrusion and the recess may be 10 to 40.

The root part may be inserted into an annular U ring having a U-shaped cross section in a non-fixed manner, and the root part may be slid radially inside the U ring based on an operating state of a gas turbine.

According to an aspect of another exemplary embodiment, there is provided a gas turbine including: a compressor configured to compress air drawn thereinto from an outside; a combustor configured to mix fuel with air compressed by the compressor and combust a mixture of the fuel and the compressed air; and a turbine including a turbine vane configured to generate power by combustion gas discharged from the combustor and to guide the combustion gas on a combustion gas path and a turbine blade configured to be rotated by the combustion gas on the combustion gas path. The turbine vane may include an airfoil; an outer shroud formed at a top of the airfoil; and an inner shroud including a stress canceling part formed at a bottom of the airfoil and configured to cancel a stress applied to the airfoil by flowing combustion gas.

The inner shroud may include a platform part configured to support the airfoil and a root part configured to be connected to a bottom surface of the platform part, and the stress canceling part may include a protrusion configured to protrude from a bottom of one surface of the root part and a recess configured to be recessed from a bottom of the other surface of the root part.

The protrusion and the recess may include inclined surfaces at predetermined angles.

The angles of the inclined surfaces may be 5° to 45°.

If a length of the root part is 100, lengths of the protrusion and the recess may be 5 to 30.

If a height of the root part is 100, heights of the protrusion and the recess may be 10 to 40.

The root part may be inserted into an annular U ring having a U-shaped cross section in a non-fixed manner, and the root part may be slid radially inside the U ring based on an operating state of the gas turbine.

According to one or more exemplary embodiments, it is possible to prevent a collision between a turbine rotor disk and a turbine vane upon an initial operation, and prevent a bending stress generated in the turbine vane upon a normal operation.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
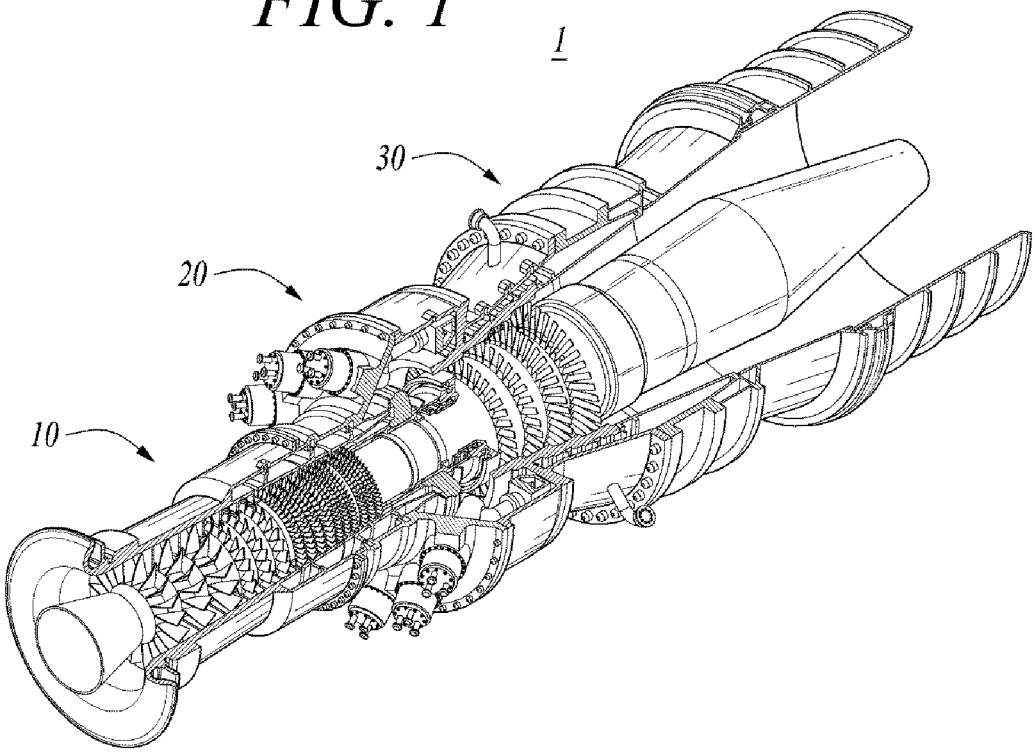
FIG. 1 is a diagram illustrating an internal structure of a gas turbine according to an exemplary embodiment.

Various modifications and various embodiments will be described in detail with reference to the drawings so that those skilled in the art can easily carry out the disclosure. It should be understood, however, that the various embodiments are not for limiting the scope of the disclosure to the specific embodiment, but they should be interpreted to include all modifications, equivalents, and alternatives of the embodiments included within the spirit and scope disclosed herein.

The terminology used herein is for the purpose of describing specific embodiments only and is not intended to limit the scope of the disclosure. In the specification, when a part "includes" a certain component, it means that the component may further include other components rather than excluding other components unless otherwise stated. Further, when an element is referred to as being "above" or "on" another element, it may be directly on the other element while making contact with the other element or may be above the other element without making contact with the other element.

Hereinafter, exemplary embodiments will be described in detail with reference to the accompanying drawings. Reference now should be made to the drawings, in which the same reference numerals are used throughout the different drawings to designate the same or similar components. Further, detailed descriptions of well-known functions and configurations which may obscure the gist of the present disclosure will be omitted. For the same reason, some components in the accompanying drawings are exaggerated, omitted, or schematically illustrated.

Figure 2:
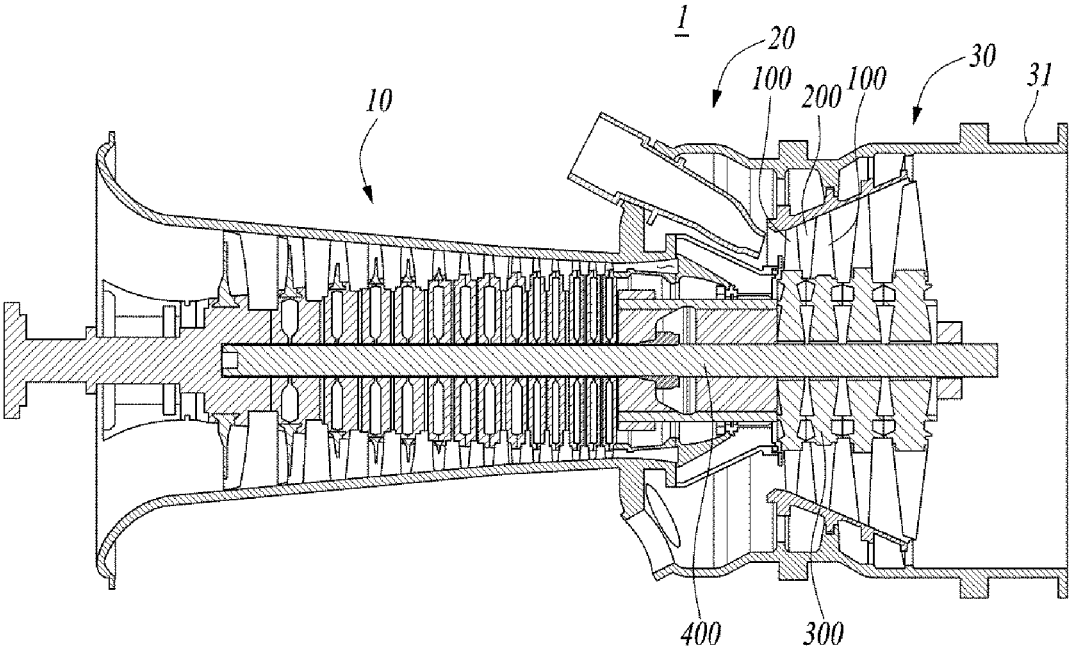
FIG. 2 is a diagram illustrating a cross section of the gas turbine according to an exemplary embodiment.

FIG. 1 is a diagram illustrating an internal structure of a gas turbine according to an exemplary embodiment, and FIG. 2 is a diagram illustrating a cross section of the gas turbine according to an exemplary embodiment.

Referring to FIGS. 1 and 2, a gas turbine 1 includes a compressor 10, a combustor 20, and a turbine 30. The compressor 10 serves to compress the introduced air at a high pressure, and transfers the compressed air to the combustor 20. The compressor 10 including a plurality of compressor blades radially installed rotates the compressor blade by receiving a part of power which is generated by the rotation of the turbine 30, and the air is compressed and moved to the combustor 20 by the rotation of the compressor blade. A size and installation angle of the blade may be changed according to an installation location.

The air compressed by the compressor 10 moves to the combustor 20 and is mixed with fuel through a plurality of combustion chambers and fuel nozzle modules, which are arranged in an annular shape, to be combusted. The high-temperature combustion gas is discharged to the turbine 30, and the turbine is rotated by the combustion gas.

The turbine 30 is arranged in multiple stages through a center tie rod 400 which axially couples turbine rotor disks 300. The turbine rotor disks 300 include a plurality of turbine blades 100 which are arranged radially. The turbine blade 100 may be coupled to the turbine rotor disk 300 in a dovetail or the like manner. Further, turbine vanes 200 fixed to a housing 31 are provided between the turbine blades 100 to guide the flow direction of the combustion gas passing through the turbine blades 100.

As illustrated in FIG. 2, the turbine 30 may include the turbine vanes 200 and the turbine blades 100 which are alternately arranged along an axis direction of the gas turbine 1. The high-temperature combustion gas passes through the turbine vanes 200 and the turbine blades 100 along the axis direction and rotates the turbine blades 100.

Figure 3:
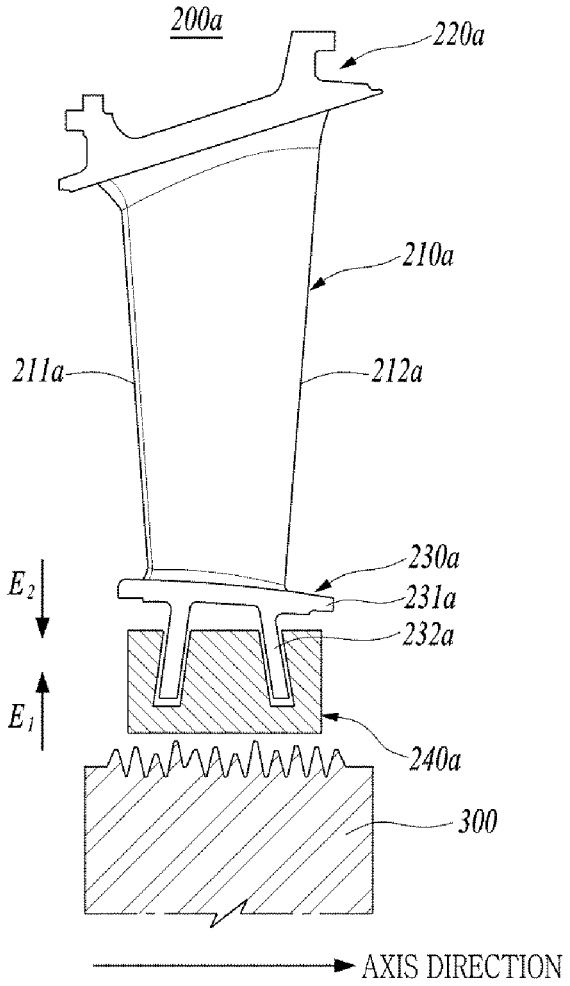
FIG. 3 is a diagram illustrating a related art turbine vane.
Figure 4:
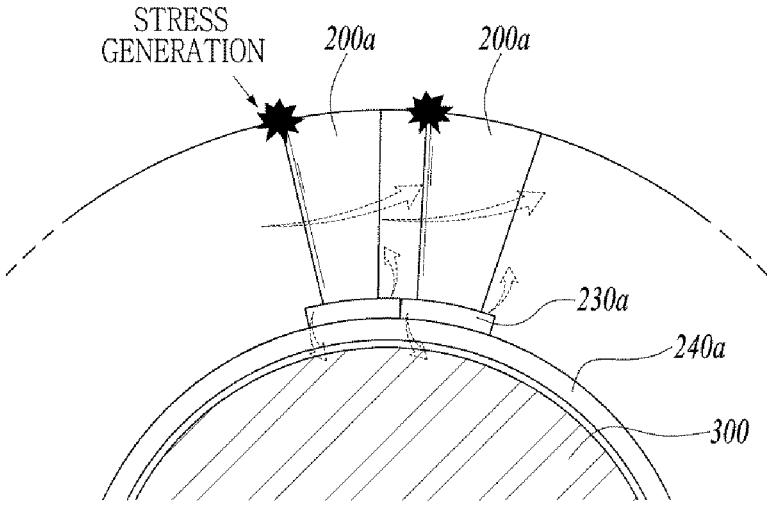
FIG. 4 is a diagram for explaining a problem which occurs upon an operation of the gas turbine having the turbine vane illustrated in FIG. 3.

FIG. 3 is a diagram illustrating a related art turbine vane, and FIG. 4 is a diagram for explaining a problem which occurs upon an operation of the gas turbine having the turbine vane illustrated in FIG. 3.

Referring to FIG. 3, the related art turbine vane 200*a* includes an airfoil 210*a*, an outer shroud 220*a* formed on a top of the airfoil 210*a*, and an inner shroud 230*a* formed on a bottom of the airfoil 210*a*.

The airfoil 210*a* includes a leading edge 211*a* and a trailing edge 212*a*. The leading edge 211*a* is an end of a front portion which receives the fluid flowing in the airfoil 210*a*, and the trailing edge 212*a* is an end of a rear portion of the airfoil 210*a*. The airfoil 210*a* has a pressure side and a suction side which are formed by connecting the leading edge 211*a* with the trailing edge 212*a*, and the flowing fluid applies pressure to the pressure side.

The inner shroud 230*a* and the outer shroud 220*a* are disposed at both ends of the airfoil 210*a* to support the airfoil

210*a*, and may include a platform part and a root part, respectively. The turbine vane 200*a* includes the inner shroud 230*a* which is disposed toward an inner rotational axis of the gas turbine, and the outer shroud 220*a* which is disposed toward an outside of the gas turbine.

The platform part 231*a* of the inner shroud 230*a* has a plate shape so that the plate surface faces the airfoil 210*a*, and the root part 232*a* of the inner shroud 230*a* is disposed on a surface opposite to an outer plate surface of the platform part 231*a*, that is, the plate surface contacting the airfoil 210*a*, and formed to extend outward from the platform part 231*a*. A U-ring 240*a* having substantially a U shape is fastened to a bottom of the root part 232*a*, and the turbine rotor disk 300 is formed to be spaced apart from a bottom of the U-ring 240*a*. The U-ring 240*a* prevents the root part 232*a* from contacting the turbine rotor disk 300.

When the gas turbine is operated by using the related art turbine vane 200*a*, the turbine rotor disk 300 expands toward the turbine vane 200*a* (i.e., an arrow E1), and the turbine vane 200*a* fixed to a case expands toward the turbine rotor disk 300 (i.e., an arrow E2) by a centrifugal force caused by the rotation of the turbine rotor disk 300 and heat applied to the turbine rotor disk 300 during the initial operation but the turbine rotor disk 300 and the turbine vane 200*a* may vertically move inside the U-ring 240*a*, thereby preventing the root part 232*a* of the turbine vane 200*a* from contacting the turbine rotor disk 300.

However, as illustrated in FIG. 4, if the combustion gas generated by the combustor 20 collides with the turbine vane 200*a*, gas flows from the pressure side of the turbine vane 200*a* to the suction side based on the shape of the airfoil. The gas flow applies a force in one direction to the turbine vane 200*a*. There is a concern that a bending stress is generated by this force on a top portion of the turbine vane 200*a*, that is, a portion in which the airfoil 210*a* and the outer shroud are connected, and the turbine vane is damaged by the generation of the continuous bending stress. Meanwhile, one side of the bottom portion of the turbine vane moves upward, and the other side of the bottom portion of the turbine vane moves downward by this force. Here, the portion in which the airfoil and the outer shroud are connected acts as a fixed end, and one side of the bottom portion of the turbine vane acts as a free end because there is no fixed portion, which may cause damage to the seal plate of the turbine vane.

Figure 5:
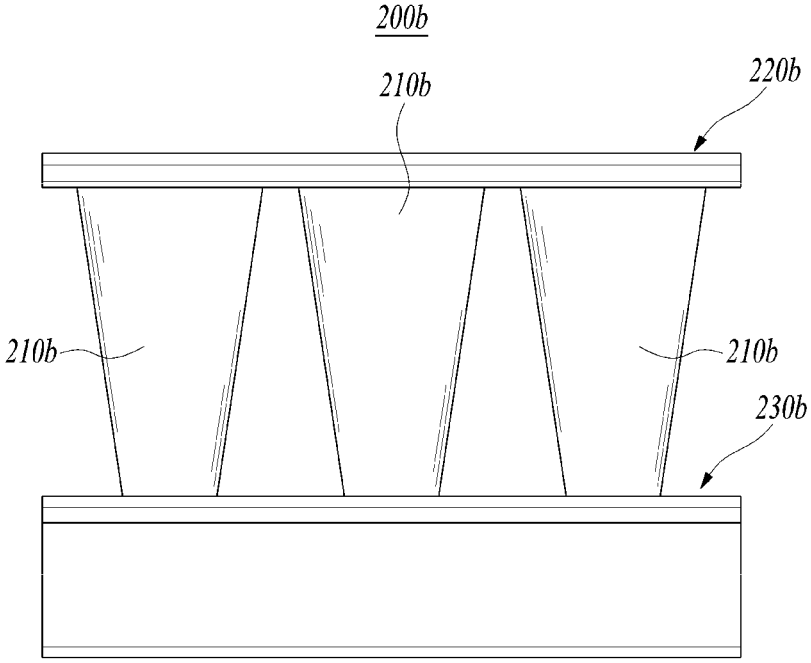
FIG. 5 is a diagram illustrating another related art turbine vane.

Meanwhile, another related art turbine vane 200*b*, which is designed to solve the problems in FIGS. 3 and 4, is illustrated in FIG. 5. FIG. 5 is a diagram illustrating another related art turbine vane.

Referring to FIG. 5, another related art turbine vane 200*b* is a multi-airfoil in which a plurality of airfoils 210*b* are integrally formed. The turbine vane 200*b* integrally forms a plurality of airfoils 210*b* between the outer shroud 220*b* and the inner shroud 230*b*, thereby partially eliminating the bending stress of the portion in which the airfoil 210*b* and the outer shroud 220*b* are connected.

However, the related art turbine vane 200*b* causes problems. For example, there are problems in that because the plurality of airfoils 210*b* are integrally formed, it is difficult to perform a coating work which coats the surface of the airfoil 210*b* by spatial interference between the airfoils 210*b*, and it is also difficult to perform a cooling hole processing work which forms a cooling hole in the surface of the airfoil 210*b*. As a result, there is a problem in that the efficiency of the gas turbine is reduced.

The turbine vane according to an exemplary embodiment is to solve the problems of the related art turbine vane described above, and it is possible to prevent the collision between the turbine rotor disk and the turbine vane upon an initial operation of the gas turbine, and to prevent the bending stress generated in the turbine vane upon a normal operation of the gas turbine.

Figure 6:
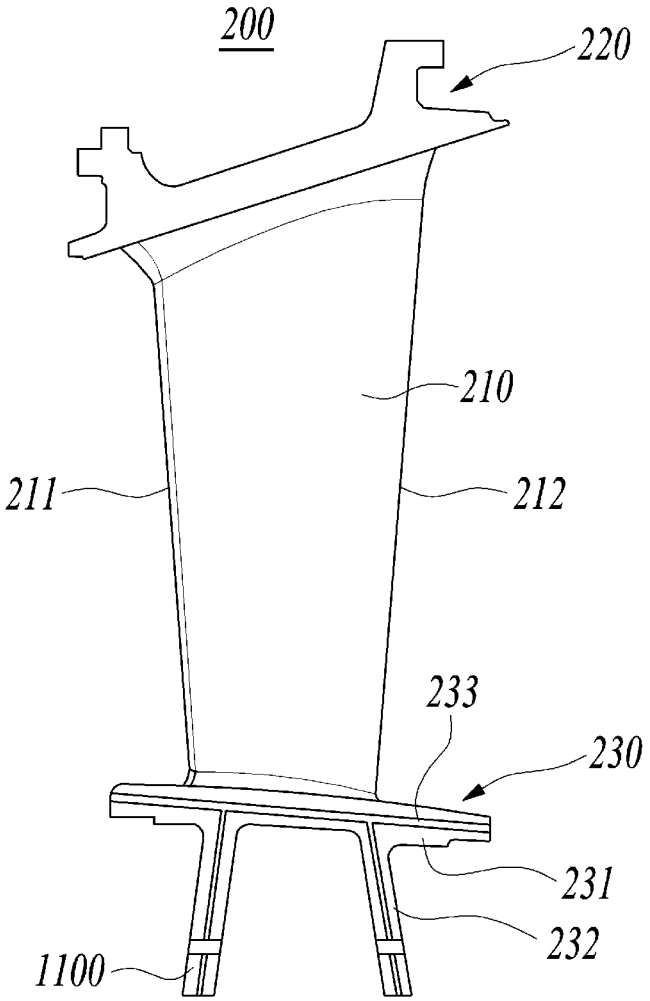
FIG. 6 is a front diagram illustrating a turbine vane according to an exemplary embodiment.
Figure 7:
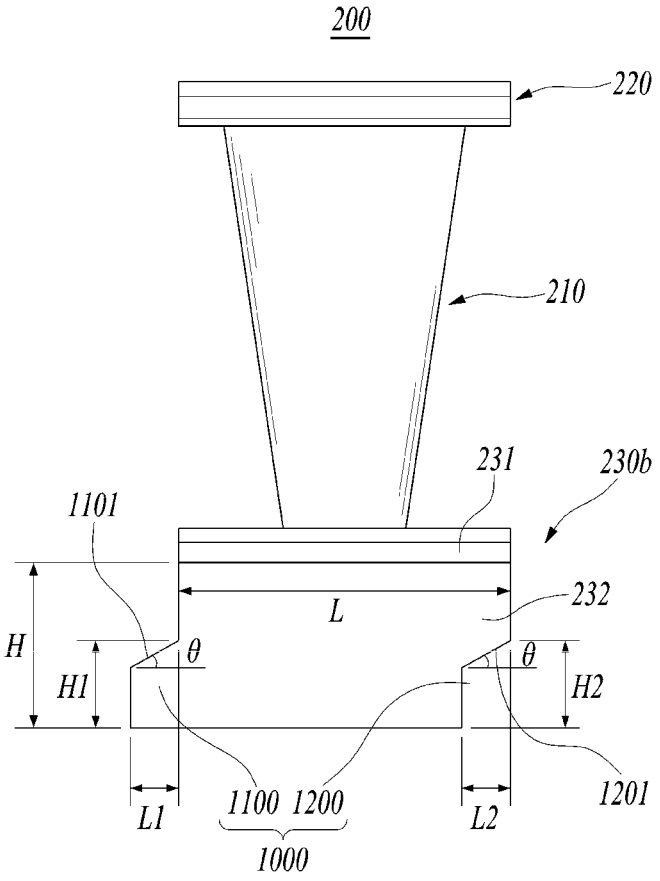
FIG. 7 is a side diagram illustrating the turbine vane of FIG. 6.
Figure 8:
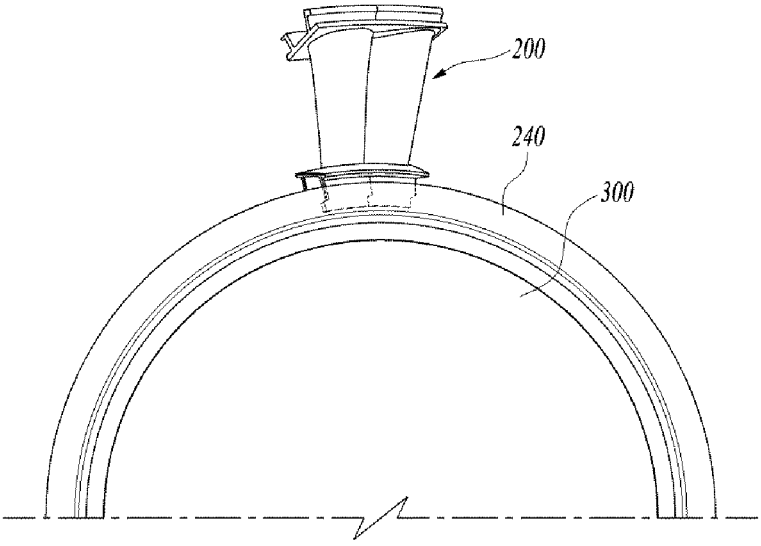
FIG. 8 is a diagram illustrating a case in which the turbine vane of FIG. 6 is inserted into an annular U ring in a non-fixed manner.
Figure 9:
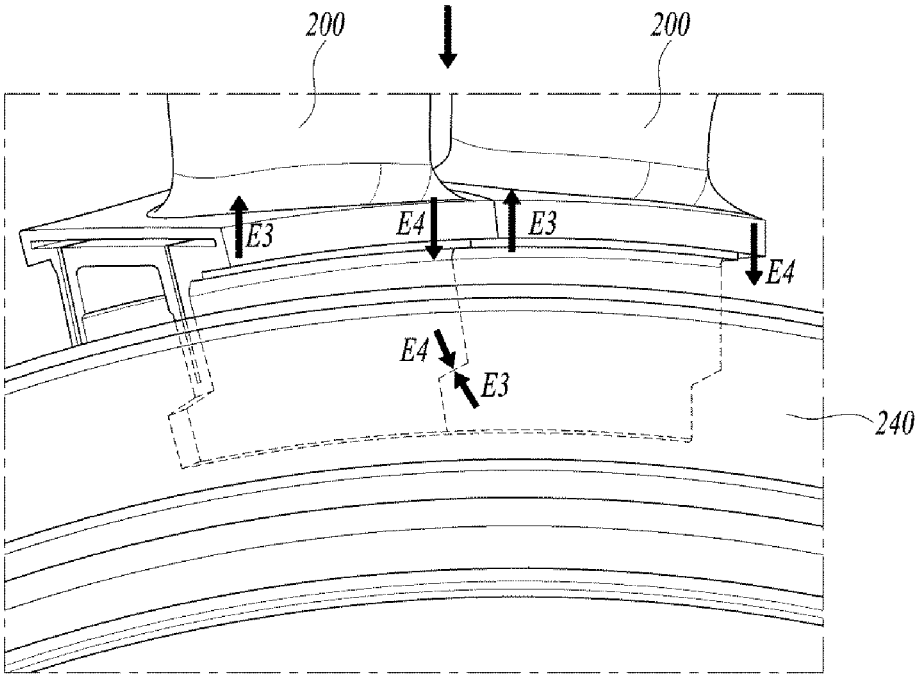
FIG. 9 is a diagram for explaining a process of cancelling stress which is applied to an airfoil by the turbine vane according to an exemplary embodiment.

FIG. 6 is a front diagram illustrating a turbine vane according to an exemplary embodiment, FIG. 7 is a side diagram illustrating the turbine vane of FIG. 6, FIG. 8 is a diagram illustrating a case in which the turbine vane of FIG. 6 is inserted into an annular U ring in a non-fixed manner, and FIG. 9 is a diagram for explaining a process of cancelling stress which is applied to an airfoil by the turbine vane according to an exemplary embodiment.

Referring to FIGS. 6 and 7, the turbine vane 200 according to an exemplary embodiment includes an airfoil 210, an outer shroud 220 formed on a top of the airfoil 210, and an inner shroud 230 formed at a bottom of the airfoil 210, and a stress canceling part 1000 formed on the inner shroud 230.

The airfoil 210 includes a leading edge 211 and a trailing edge 212. The leading edge 211 is an end of a front portion which receives the fluid flowing in the airfoil 210, and the trailing edge 212 is an end of a rear portion of the airfoil 210. The airfoil 210 includes a pressure side and a suction side which are formed by connecting the leading edge 211 with the trailing edge 212, and the flowing fluid applies pressure to the pressure side.

The inner shroud 230 and the outer shroud 220 are disposed at both ends of the airfoil 210 to support the airfoil 210, and may include a platform part and a root part, respectively. The inner shroud 230 is disposed at the turbine rotor disk 300, and the outer shroud 220 is disposed at the case of the gas turbine.

The platform part 231 of the inner shroud 230 has a plate shape so that the plate surface faces the airfoil 210, and the root part 232 extends downward from the platform part 231. A cooling passage 233 for cooling is formed inside the platform part 231 and the root part 232.

The stress canceling part 1000 cancels the stress which is applied to the airfoil 210 by the flowing combustion gas. The stress canceling part 1000 includes a protrusion 1100 and a recess 1200.

The protrusion 1100 is formed to protrude in one direction from a bottom of one surface of the root part 232, and the recess 1200 is formed to be recessed in one direction from a bottom of the other surface of the root part 232. The protrusion 1100 formed in the root part 232 of any one airfoil is inserted into and contacts the recess 1200 formed in the root part 232 of an adjacent airfoil.

For example, the protrusion 1100 and the recess 1200 have inclined surfaces 1101, 1201 at predetermined angles. The angles (θ) of the inclined surfaces 1101, 1201 is not particularly limited, but is preferably 5° to 30°. There is a disadvantage in that assembly is impossible due to an interference during assembly if angles of the inclined surfaces 1101, 1201 are smaller than 5°, and there is a disadvantage in that a bending is not cancelled each other if angles of the inclined surfaces 1101, 1201 exceed 45°.

In addition, although not particularly limited, assuming that a length (L) of the root part 232 is 100, lengths (L1, L2) of the protrusion 1100 and the recess 1200 are preferably 5 to 30. There is a disadvantage in that the bending is not canceled each other due to a gap between the vanes if the lengths (L1, L2) are smaller than 5, and there is a disadvantage in that a stress is concentrated in corners if the lengths (L1, L2) exceed 30.

Further, although not particularly limited, assuming that a height (H) of the root part 232 is 100, heights (H1, H2) of the protrusion 1100 and the recess 1200 are preferably 10 to 40. There is a disadvantage in that breaking is occurred due to stress concentration in the corners if the heights (H1, H2) are smaller than 10, and there is a disadvantage in that an amount of canceling the bending each other is insignificant if the heights (H1, H2) exceed 40.

Referring to FIG. 8, the turbine vane 200 is inserted into an annular U-ring 240 having a U-shaped cross section in a non-fixed manner. A constant gap is formed between the root parts 232 of the plurality of turbine vanes 200.

During the initial operation of the gas turbine, the turbine rotor disk 300 expands toward the turbine vane 200 by a centrifugal force caused by the rotation of the turbine rotor disk 300 and the heat applied to the turbine rotor disk 300, and the turbine vane 200 fixed to the case expands toward the turbine rotor disk 300, but the turbine rotor disk 300 and the turbine vane 200 may vertically slide inside the U-ring 240, thereby preventing the root part 232 of the turbine vane 200 from contacting the turbine rotor disk 300.

Referring to FIG. 9, during the normal operation of the gas turbine, an upward displacement (i.e., an arrow E3) is caused at one side of the turbine vane 200 and the protrusion 1100 by the flow of the combustion gas, and a downward displacement (i.e., an arrow E4) is caused at the other side of the turbine vane 200 and the recess 1200.

Because the displacements caused by the protrusion 1100 and the recess 1200 are in directions opposite to each other, it is possible to entirely cancel the stress applied to the airfoil 210, thereby improving a design life of the airfoil 210.

Further, because the airfoil is manufactured in a single airfoil rather than a multi-airfoil type, there is no spatial interference problem between the airfoils 210 unlike the turbine vane 200*b* of FIG. 5 manufactured in the multi-airfoil form for a reduction in the stress, such that it is possible to easily perform a coating work which coats the surface of the airfoil 210, and to easily perform a cooling hole processing work which forms the cooling hole in the surface of the airfoil 210, thereby improving the efficiency of the gas turbine.

While one or more exemplary embodiments have been described with reference to the accompanying drawings, it is to be understood by those skilled in the art that various modifications and changes in form and details may be made therein without departing from the spirit and scope as defined by the appended claims. Accordingly, the description of the exemplary embodiments should be construed in a descriptive sense only and not to limit the scope of the claims, and many alternatives, modifications, and variations will be apparent to those skilled in the art.

What is claimed is:

1. An inner shroud of a turbine vane comprising:

a platform part configured to support a single airfoil;

a root part configured to be connected to a bottom surface of the platform part; and a stress canceling part formed at a bottom of the single airfoil and configured to cancel a stress applied to the single airfoil by flowing combustion gas, wherein the stress canceling part comprises a protrusion configured to protrude from a bottom of one surface of the root part and a recess configured to be recessed from a bottom of the other surface of the root part, the protrusion formed in the root part of one airfoil being inserted into and contacting the recess formed in the root part of an adjacent airfoil, wherein the protrusion formed in the root part and the recess formed in the root part include inclined surfaces at predetermined angles, wherein the stress applied to the single airfoil by the flowing combustion gas is canceled based on an upward displacement caused at the protrusion and a downward displacement caused at the recess during a normal operation of the turbine, and wherein a cooling passage for cooling is formed inside the platform part and the root part.

2. The inner shroud of the turbine vane of claim 1, wherein the angles of the inclined surfaces are 5° to 45°.

3. The inner shroud of the turbine vane of claim 1, wherein if a length of the root part is 100, lengths of the protrusion and the recess are 5 to 30.

4. The inner shroud of the turbine vane of claim 1, wherein if a height of the root part is 100, heights of the protrusion and the recess are 10 to 40.

5. A turbine vane comprising:

a single airfoil;

an outer shroud formed at a top of the single airfoil; and an inner shroud including a stress canceling part formed at a bottom of the single airfoil and configured to cancel a stress applied to the single airfoil by flowing combustion gas, wherein the inner shroud comprises a platform part configured to support the single airfoil and a root part configured to be connected to a bottom surface of the platform part, and wherein the stress canceling part comprises a protrusion configured to protrude from a bottom of one surface of the root part and a recess configured to be recessed from a bottom of the other surface of the root part, the protrusion formed in the root part of one airfoil being inserted into and contacting the recess formed in the root part of an adjacent airfoil, wherein the protrusion formed in the root part and the recess formed in the root part include inclined surfaces at predetermined angles, wherein the stress applied to the single airfoil by the flowing combustion gas is canceled based on an upward displacement caused at the protrusion and a downward displacement caused at the recess during a normal operation of the turbine, and wherein a cooling passage for cooling is formed inside the platform part and the root part.

6. The turbine vane of claim 5, wherein the angles of the inclined surfaces are 5° to 45°.

7. The turbine vane of claim 5, wherein if a length of the root part is 100, lengths of the protrusion and the recess are 5 to 30.

8. The turbine vane of claim 5, wherein if a height of the root part is 100, heights of the protrusion and the recess are 10 to 40.

9. The turbine vane of claim 5, wherein the root part is inserted into an annular U ring having a U-shaped cross section in a non-fixed manner, and the root part is slid radially inside the U ring based on an operating state of a gas turbine.

10. A gas turbine comprising:

a compressor configured to compress air drawn thereinto from an outside;

a combustor configured to mix fuel with air compressed by the compressor and combust a mixture of the fuel and the compressed air; and a turbine including a turbine vane configured to generate power by combustion gas discharged from the combustor and to guide the combustion gas on a combustion gas path and a turbine blade configured to be rotated by the combustion gas on the combustion gas path, wherein the turbine vane comprises a single airfoil;

an outer shroud formed at a top of the single airfoil; and an inner shroud including a stress canceling part formed at a bottom of the single airfoil and configured to cancel a stress applied to the single airfoil by flowing combustion gas, wherein the inner shroud comprises a platform part configured to support the single airfoil and a root part configured to be connected to a bottom surface of the platform part, and wherein the stress canceling part comprises a protrusion configured to protrude from a bottom of one surface of the root part and a recess configured to be recessed from a bottom of the other surface of the root part, the protrusion formed in the root part of one airfoil being inserted into and contacting the recess formed in the root part of an adjacent airfoil, wherein the protrusion formed in the root part and the recess formed in the root part include inclined surfaces at predetermined angles, wherein the stress applied to the single airfoil by the flowing combustion gas is canceled based on an upward displacement caused at the protrusion and a downward displacement caused at the recess during a normal operation of the turbine, and wherein a cooling passage for cooling is formed inside the platform part and the root part.

11. The gas turbine of claim 10, wherein the angles of the inclined surfaces are 5° to 45°.

12. The gas turbine of claim 10, wherein if a length of the root part is 100, lengths of the protrusion and the recess are 5 to 30.

13. The gas turbine of claim 10, wherein if a height of the root part is 100, heights of the protrusion and the recess are 10 to 40.

14. The gas turbine of claim 10, wherein the root part is inserted into an annular U ring having a U-shaped cross section in a non-fixed manner, and the root part is slid radially inside the U ring based on an operating state of the gas turbine.

* * * * *